United States Patent [19]

Bowser

[11] 4,108,061

[45] Aug. 22, 1978

[54] PALLETIZER WITH TIER SHEET INSERTER AND BANDING MEANS

[75] Inventor: Robert E. Bowser, Lynchburg, Va.

[73] Assignee: Simplimatic Engineering Co., Lynchburg, Va.

[21] Appl. No.: 761,583

[22] Filed: Jan. 24, 1977

[51] Int. Cl.[2] ..... B65B 13/14

[52] U.S. Cl. ..... 100/7; 100/26; 214/6 P; 271/20

[58] Field of Search ..... 214/6 P, 6 DK; 100/7, 100/26, 4; 271/20

[56] References Cited

U.S. PATENT DOCUMENTS

| | | | |
|---|---|---|---|
| 2,946,465 | 7/1960 | Raynor | 214/6 P |
| 2,959,118 | 11/1960 | Hager | 100/26 |
| 2,997,187 | 8/1961 | Burt | 214/6 P |
| 3,533,351 | 10/1970 | Lehmann | 100/26 |
| 3,809,388 | 5/1974 | Downing | 271/20 |
| 3,929,062 | 12/1975 | Thompson | 100/26 |

*Primary Examiner*—Billy J. Wilhite
*Attorney, Agent, or Firm*—James & Franklin

[57] ABSTRACT

The operations of the palletizer are automatically controlled by a prerecorded control program. The palletizer includes a vertical shaft, a retractable draw plate located above the shaft and a drive mechanism for moving a hoist along the shaft. After a tier of cartons is formed on the unretracted draw plate, a tier sheet inserter extracts a single tier sheet from a stack and places the sheet on top of the tier. The draw plate is then retracted, placing the tier on the hoist and the hoist is lowered until the tier is aligned with the banding mechanism, which is located within the shaft. The banding mechanism places a strap around the tier, tensions the strap and fastens same. The hoist is then repositioned to accept the next tier as same is deposited thereon by the draw plate.

23 Claims, 20 Drawing Figures

110
120
35
114
120
35
116
134
132
121
136
126
124
122
124
125
130
123
FROM REMOTE REEL

PALLETIZER WITH TIER SHEET INSERTER AND BANDING MEANS

The present invention relates to an automatic palletizing apparatus and, in particular, to a palletizer having a tier sheet inserter and banding means.

A palletizer is a materials handling apparatus which accepts objects, such as cartons or the like, from a conveyor belt and places these objects in a predetermined configuration on a pallet, which is subsequently removed for shipping or storage. Normally, the palletizer first appropriately orients the incoming cartons and then forms a row thereof. Several rows are aggregated to form a tier, which is placed on a retractable draw plate. The retractable draw plate is positioned on top of a vertical shaft, along which a hoist is movable. A pallet is placed on the hoist and the hoist is positioned immediately below the draw plate. The draw plate is retracted, placing the tier of cartons on the pallet. The hoist is lowered and the draw plate repositioned to receive the next tier of cartons. After the required number of tiers have been placed on the pallet, the hoist is lowered and the pallet, with the cartons thereon, removed. All of these operations are normally achieved completely automatically through the use of programmable control apparatus connected, by means of strategically placed sensors, to monitor carton movement through the palletizer and to regulate and time the operation of various functions of the palletizer. The apparatus can also be used without a pallet, the cartons being placed directly on the hoist lift table. In this latter case, the apparatus functions as a unitizer, and use in this document of the term "palletizer" includes apparatus functioning as a unitizer or in any analogous way.

It is often desirable to place a tier separation sheet between some or all of the tiers of cartons as a multitier load is formed on the pallet. Such a sheet may be composed of thick paper or cardboard and is utilized to maintain separation between the tiers, as well as to maintain the integrity of the load. In the past, tier sheet insertion was accomplished manually or by a machine designed for this purpose, but which was operated independently from other equipment; for example, see U.S. Pat. No. 3,809,388 to Downing, issued May 7, 1974. Manual tier sheet insertion has the obvious drawback of requiring an operator to perform this function, a requirement which defeats the basic purpose of the automatic palletizing apparatus, namely, a reduction in labor costs. The prior art machinery designed to perform this function was separate and distinct from other materials handling equipment and, therefore, there is no way to integrate the tier sheet inserting mechanism with the remainder of the palletizer to perform this function completely automatically.

It is also desirable, in some instances, to strap or band the cartons together, some or all of the tiers, to maintain the intregrity of the load and permit a greater number of tiers to be placed on a palletizer, without the risk of the load accidentally disintegrating during handling of the pallet for shipping or storage. Strapping or banding machines, both of the vertical and horizontal banding types, are known in the art and are commercially available for use in a variety of different applications. However, prior to the present invention, there had not been developed a strapping or banding mechanism which could be integrated as part of an automatic palletizing apparatus. Such a mechanism must perform the strapping or banding operation automatically on selected tiers of cartons in accordance with a control program as the tiers are formed and placed on the pallet. Moreover, it must operate in a manner which does not interfere with the remainder of the palletizing operation and which does not require the presence of an operator whose function is to separately operate a strapping and banding mechanism.

It is, therefore, a prime object of the present invention to provide a completely automatic palletizing apparatus which, in addition to the conventional palletizing operations, is also capable of inserting sheet separators between selected tiers of cartons and strapping the cartons forming selected tiers together, both operations being in accordance with a predetermined control program.

It is a second object of the present invention to provide a palletizer with tier sheet insertion capability which can accommodate tier sheets of various sizes.

It is another object of the present invention to provide a palletizer with strapping or banding capability which can accommodate tiers of cartons of various dimensions.

It is a further object of the present invention to provide a palletizer with a tier sheet inserter and banding means, each of which function in sequence without interrupting or interfering with the remainder of the palletizing operation.

In accordance with the present invention, a palletizer is provided with a vertical shaft, along which a hoist is moved by means of a drive mechanism. A retractable draw plate is located above the shaft and, in its unretracted position, a tier of cartons or other objects to be palletized is formed thereon. When required by the control program, means located above the shaft, automatically extracts a single separation sheet from a stack thereof and, in sequence, places the tier separation sheet on the tier. This operation takes place prior to retraction of the draw plate. The hoist is positioned immediately below the draw plate so as to receive the tier, with the tier sheet thereon, upon retraction of the draw plate. Thereafter, if the program requires that the newly formed tier be banded together, the hoist is lowered to a position where the tier is aligned with the strapping or banding apparatus. The strapping or banding apparatus places a strap or band around the tier, tightens same and then seals the band or strap. The hoist is then repositioned to receive the next tier from the draw plate.

The tier sheet inserter includes a platform or the like supporting a stack of tier sheets. The platform is preferably situated alongside the hoist shaft below a movable carriage upon which is mounted a suction mechanism for extracting a single sheet from the stack and for retaining same. Once the sheet is extracted, the carriage is moved such that the sheet is positioned immediately above the tier on the draw plate. Means are provided for releasing the suction mechanism such that the sheet is positioned on the top of the tier. In accordance with the control program, the tier sheet insertion operation takes place automatically after the tier is formed on the draw plate, but before the retraction thereof, such that it does not interfere with any other operations of the palletizing apparatus.

The strapping or banding means is located within the vertical shaft below the draw plate. This mechanism includes a segmented track which is normally located outside the path of movement of the hoist and, thus, surrounds, but is normally remote from the tier located on the hoist when the tier is aligned therewith. The track has four separate segments and is provided with means for conveying a strap or band along the track, such that it encircles the tier. A tensioning and sealing means is associated with one of the segments of the track. After the strap is appropriately positioned, opposed segments of the track, including the one associated with the tensioning and sealing means, are moved to a position adjacent opposite sides of the tier. The tensioning and sealing means tightens the strap or band, causing same to be released by the track and to be situated snugly around the tier. When the appropriate tension is achieved, the band or strap is sealed. Thereafter, the track segments return to their original positions remote from the hoist path. The hoist is then positioned to receive the next tier of objects. In this manner, the strapping or banding operation takes place automatically without interfering with the other operations of the palletizer.

The palletizer described herein is provided with a programmable control mechanism for regulating and timing the various operations of the palletizer. The mechanism not only controls the configuration of the load, namely, the orientation of the cartons, the number of cartons in a row, the number of rows in a tier and the number of tiers in the completed load, but also controls the operation of the tier sheet inserting mechanism, providing for the insertion of tier sheets between selected tiers, and the strapping or banding apparatus, providing for the strapping or banding of selected tiers of cartons. Strategically located sensors, operably connected to the control mechanism, are utilized to monitor the movement of cartons through the apparatus. The palletizer is not only completely automatic, but is also versatile enough to accommodate a multitude of different load configurations, tier sheet sizes and different shape and size cartons through the appropriate changes in the program.

To the accomplishment of the above, and to such other objects as may hereinafter appear, the present invention relates to a palletizer with a tier sheet inserter and a banding means, as described in the present specification and set forth in the annexed claims, taken together with the accompanying drawings wherein like numerals refer to like parts and in which:

Figure 1:
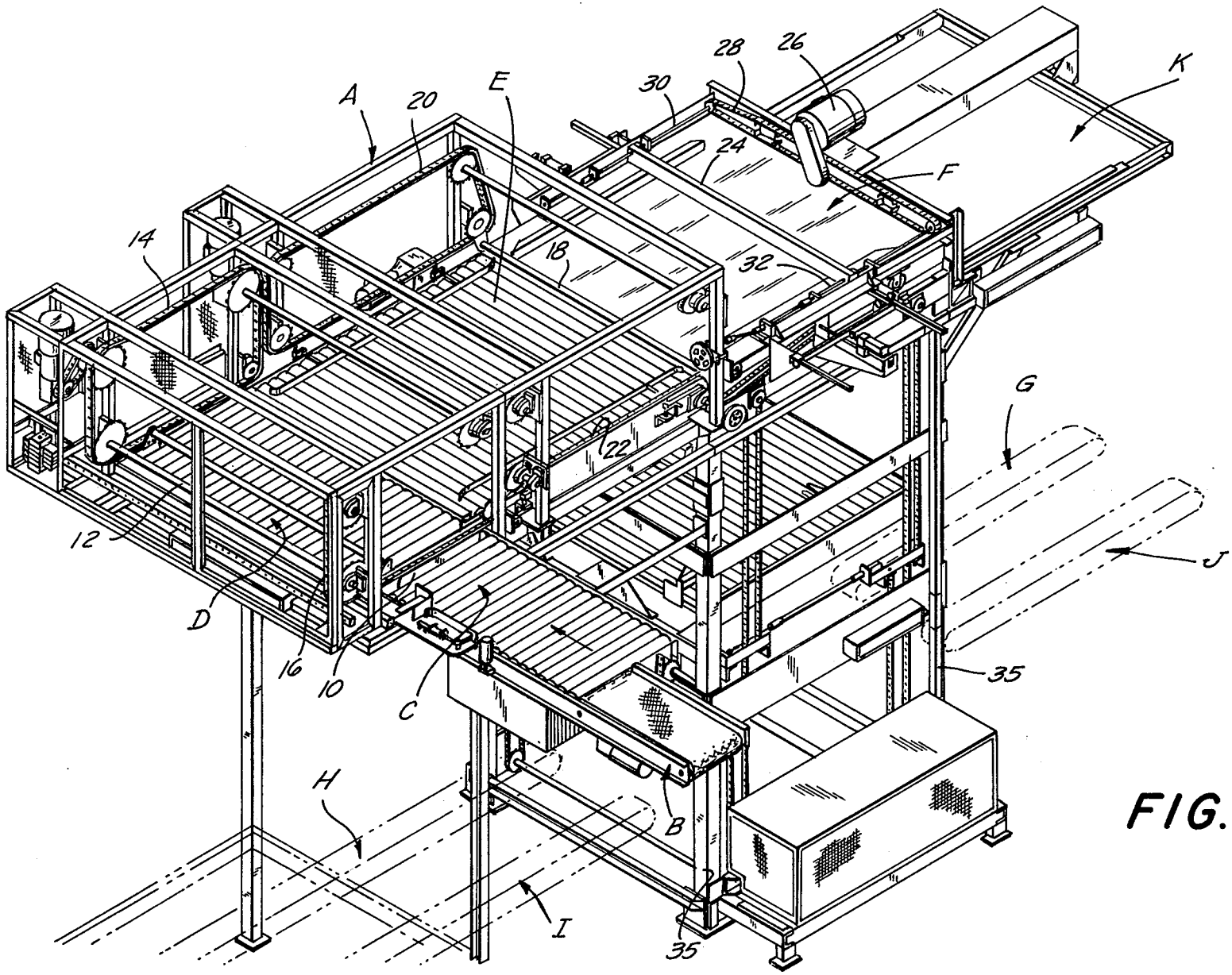
FIG. 1 is an isometric view of a basic palletizer unit with which the tier sheet inserter and banding means of the present invention can be combined.

FIG. 1 illustrates an automatic palletizer of the type with which the tier sheet inserter and banding means can be integrated to form the present invention. The palletizer comprises a support structure, generally designated A, including vertical and horizontal supporting frame members. The support structure A may also include an operator's platform and stairway to provide access by personnel to the various portions of the palletizer. However, the operator's platform and stairway are not shown in this Figure. Structure A may be arranged in a variety of different layout configurations, depending upon the particular requirements of the palletizer. A similar palletizer having a somewhat different layout is described and illustrated in my copending application Ser. No. 642,576, filed Dec. 19, 1975, now U.S. Pat. No. 4,073,387 and entitled "Method and Apparatus for Tier Forming on a Row-by-Row Basis." That application describes the overall operation of the palletizer illustrated therein and is specifically directed towards the manner in which a tier of cartons is formed.

For a full appreciation of the present invention, it is necessary that the operation of the palletizer shown in FIG. 1 be understood in a general manner. Incoming cartons enter the palletizer by an infeed conveyor, generally designated B. Apparatus for flap closing and setting (not shown) and for carton inverting (not shown) may be utilized prior to or in conjunction with infeed conveyor B, if desired. The flap closer and setter acts on the flaps on the carton to the degree that the cartons will become stackable without further manipulation. The basic operation of such a flap closer and setter may take place in two steps. First, the carton flaps are closed by means of an air actuated arm and preset flap guides. Thereafter, the flap setter crimps the carton flap by means of a series of rollers. After the flaps are closed and set, the carton may be transferred to a carton inverter which may invert the carton or not, in accordance with the loading requirements.

As the cartons enter the palletizer by means of infeed conveyor B, they are metered by a brake meter belt, generally designated C, one at a time passing by a photoelectric cell. The photoelectric cell counts the cartons into the proper program pattern sequence. The brake meter belt C may deliver the carton to a carton turning apparatus (not shown), which serves to turn or rotate the carton 90°, if such a directional reorientation is called for by the program. The turning means may comprise an arm or flipper, pivotally mounted on the side of the carton path which, when appropriately positioned, engages one corner of the carton, causing the carton to rotate about that corner as it is moved by the conveyor belt such that the carton is reoriented 90° with respect to its original position.

The carton is then conveyed to a row forming table, generally designated D, wherein the appropriate number of cartons are accumulated to form the row. The row forming means D may comprise a conveyor-style roller table, having a plurality of powered rollers. A row of cartons is formed by accumulating the cartons against each other and that row is held in place by a position adjustable backstop (not shown). Should the row formation require spaces or gaps between adjacent cartons, one or more retractable row stops (not shown) may be raised by pneumatic cylinders (not shown) between the driven rollers of the row table at the appropriate position. The row stops are actuated by the programmed control circuitry and may be adjusted to provide for the proper spacing for various carton sizes and pattern variations. When the row is completed, a retractable row gate 10, situated at the end of the brake meter belt C, is raised in a manner similar to that of the row stops. Row gate 10 separates the incoming cartons from the completed row until the row sweep is completed. After the row sweep is completed, the row gate 10 retracts and the next row continues to form.

The row sweep apparatus comprises a row sweep bar 12 which is connected at each end thereof to an endless chain 14, 16, each of which is situated around four spaced sprocket wheels, forming a generally rectangular upstanding configuration above a different side of the row forming table D. The sprocket wheels are driven such that the row sweep bar 12 passes along the surface of row forming table D in a direction perpendicular to the movement of the incoming cartons so as to sweep the formed row onto the tier forming table, generally designated E, adjacent thereto. After the row sweep is completed, row sweeping bar 12 follows the path of chains 14, 16 along a return path spaced above row forming table D so as not to interfere with the formation of the next row. At the completion of its travel path, row sweeping bar 12 is positioned to sweep the next row onto the tier table after the next row is formed.

The tier forming table E is a conveyor-style roller table similar to the row forming table. After the row sweep has placed the row on the tier table, the rollers thereon can be driven to advance the row one row width, thereby permitting clearance space for receiving the next row in sequence. When the total number of rows required to form a full tier or layer has been placed on the tier table E, the rollers can be driven to advance the cartons against a tier table and stop (not shown). The tier table is preferably provided with pneumatically raisable stops (not shown) similar to those in the row forming table, to maintain separation of the rows if required by the program.

After the full tier is formed in position on the tier table E, the tier is swept onto the draw plate, generally designated F. The tier sweep is accomplished by tier sweep bar 18, which is connected on either side thereof to endless chains 20, 22, situated above each side of the tier table E. The mechanism is quite similar to the row sweep. Each of the chains 20 and 22 are positioned around four spaced sprocket wheels, situated in a generally rectangular upstanding configuration, such that the tier sweep bar 18 travels along the surface of the tier sweep table E in order to move the tier onto the adjacent draw plate F and then returns to its original position by means of a path spaced from the surface of tier table E, such that it does not interfere with the formation of the next tier of cartons.

Immediately below draw plate F, in its unretracted position, as shown in FIG. 1, is a vertically movable hoist or elevator, generally designated G, upon which a pallet may be situated. A stack of pallets (not shown) is placed in the pallet infeed area, generally designated H. One pallet at a time is removed from the bottom of the stack and transferred, by means of a pallet moving mechanism (not shown), to a pallet ready stage, generally designated I, wherein it is loaded on hoist G immediately after the removal of the previously loaded pallet therefrom. The loaded pallet is transferred to a pallet outfeed area, generally designated J, where it may be conveniently removed by a forklift truck or the like or, alternatively, automatically conveyed to a storage area.

Once the completed tier is situated on draw plate F, hoist or elevator G, containing a pallet, is moved to a position immediately beneath the draw plate. The draw plate is then retracted to the draw plate retraction area, generally designated K. A movable end stop 24, which is positionable by means of a motor 26, an endless chain 28 and rotatable threaded shafts 30, 32, is provided to prevent the tier from moving with the draw plate as the draw plate is retracted. The retraction of the draw plate F causes the carton tier situated thereon to fall a short distance onto the pallet situated on hoist G and which is then vertically repositioned along the hoist frame, such that draw plate F can be moved to its unretracted position to receive the next tier from tier forming table E.

Figure 2:
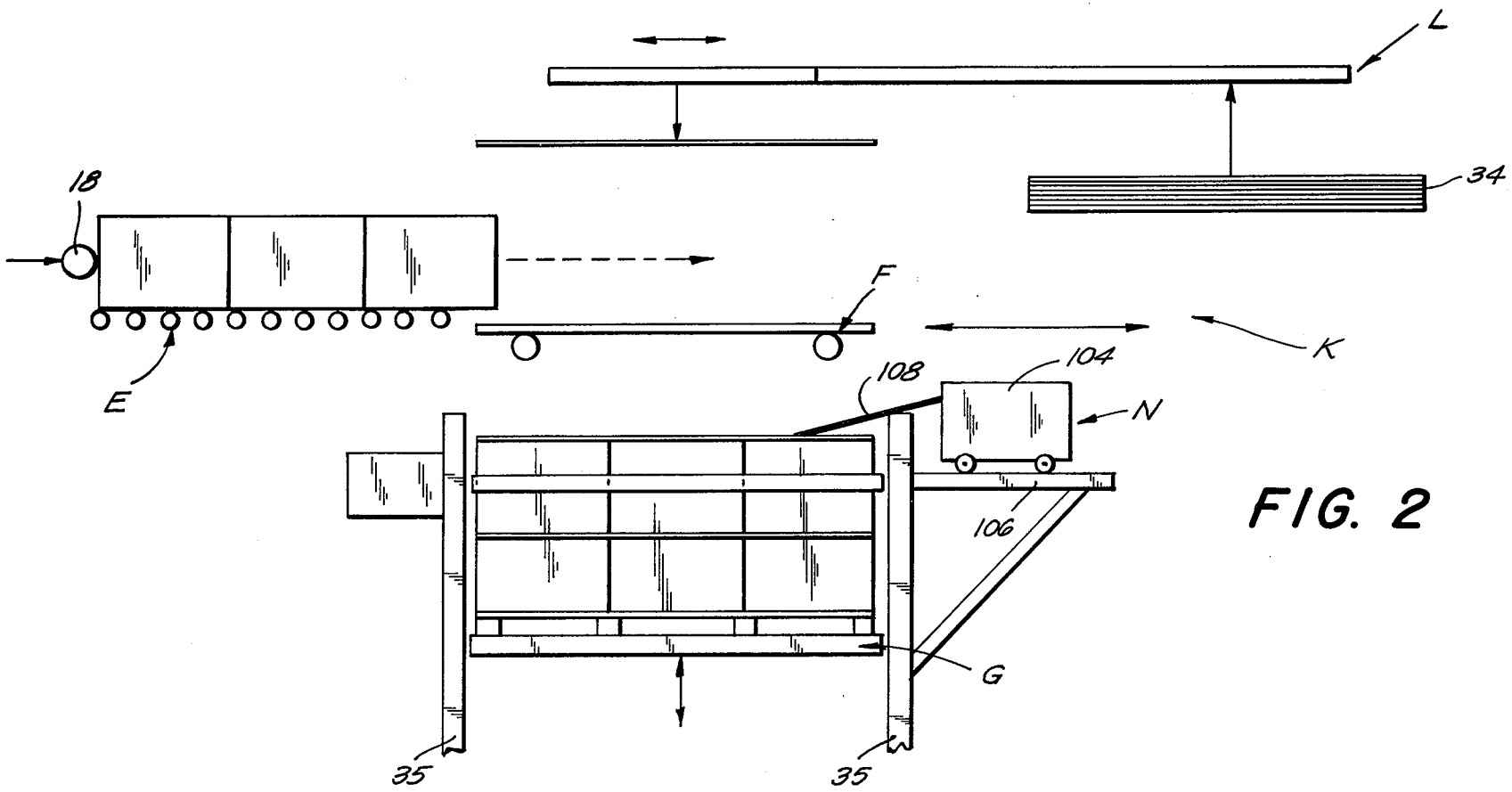
FIG. 2 is a sequential schematic view showing the manner in which the tier sheet inserter and banding means of the present invention are integrated with the palletizer unit shown in FIG. 1.

As shown schematically in FIG. 2, the palletizer illustrated in FIG. 1 has been improved by combining same with a tier sheet inserter and a tier bander. The tier sheet inserter is located above the hoist shaft and draw plate retracting mechanism. As illustrated in FIG. 2, a stack of sheets 34 is situated on a support platform located above the draw plate retraction area K. The tier sheet inserter itself is movable along horizontally extending guide rails, generally designated L, from a position above stack 34 to a position above draw plate F in its unretracted location above the hoist shaft. The sheet retaining mechanism is initially located above stack 34 and functions to lift the top sheet therefrom. The inserter, with the top sheet, is then moved along rail L to a position above the draw plate. After the tier is swept from the tier forming table E by tier sweep bar 18 onto draw plate F, the tier inserter places the lifted sheet on the top thereof. Draw plate F is then retracted such that the tier, with the sheet thereon, is located on hoist G. Hoist G is then vertically repositioned in accordance with a position sensing mechanism, generally designated N, such that the newly acquired tier is situated in alignment with the bander apparatus, generally designated M, which is situated within the hoist shaft. This permits the draw plate to be repositioned in its unretracted location so as to receive the next tier from the tier forming table E. If required by the control program, as the next tier is being formed and placed on the draw plate, the bander apparatus M places a band around the tier aligned therewith and secures same. After the banding operation is completed, the hoist G is repositioned to accept the next tier as the draw plate F is again retracted.

Figure 3:
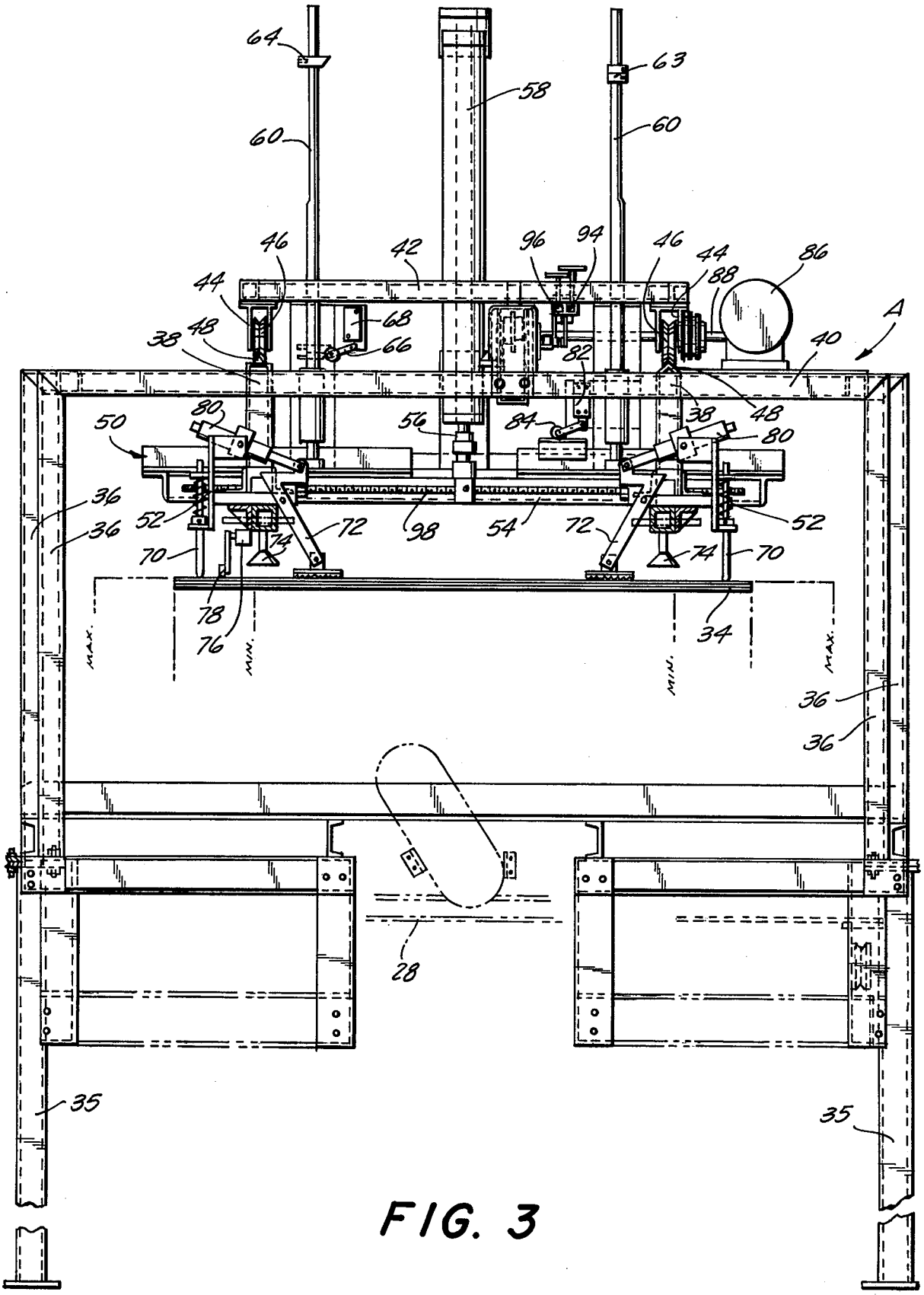
FIG. 3 is an end view of the tier sheet inserter.
Figure 4:
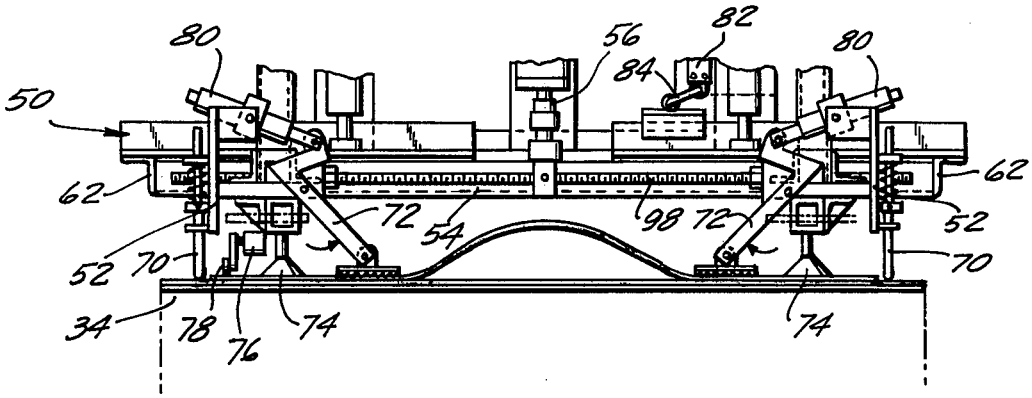
FIG. 4 is an end view of a portion of the tier sheet inserter shown in FIG. 3, showing the initial portion of the sheet lifting process.
Figure 5:
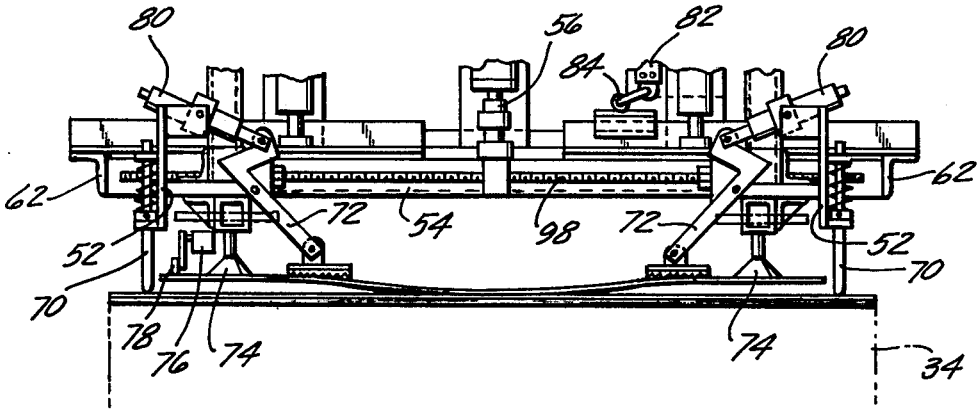
FIG. 5 is a view similar to FIG. 4, showing the next step in the sheet lifting process.
Figure 6:
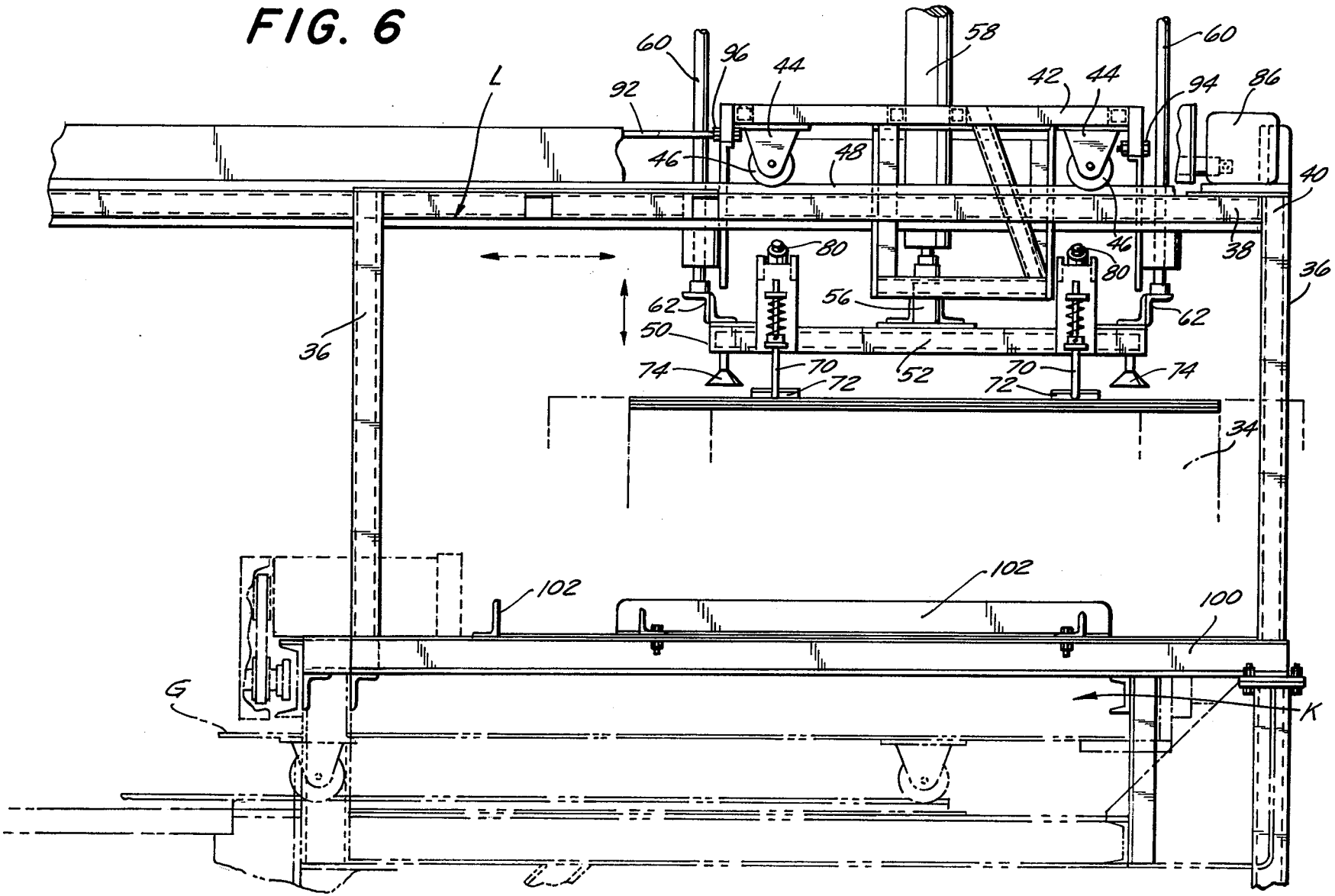
FIG. 6 is a side view of the tier sheet inserter shown in FIG. 3, showing the inserter in the sheet lifting position.
Figure 7:
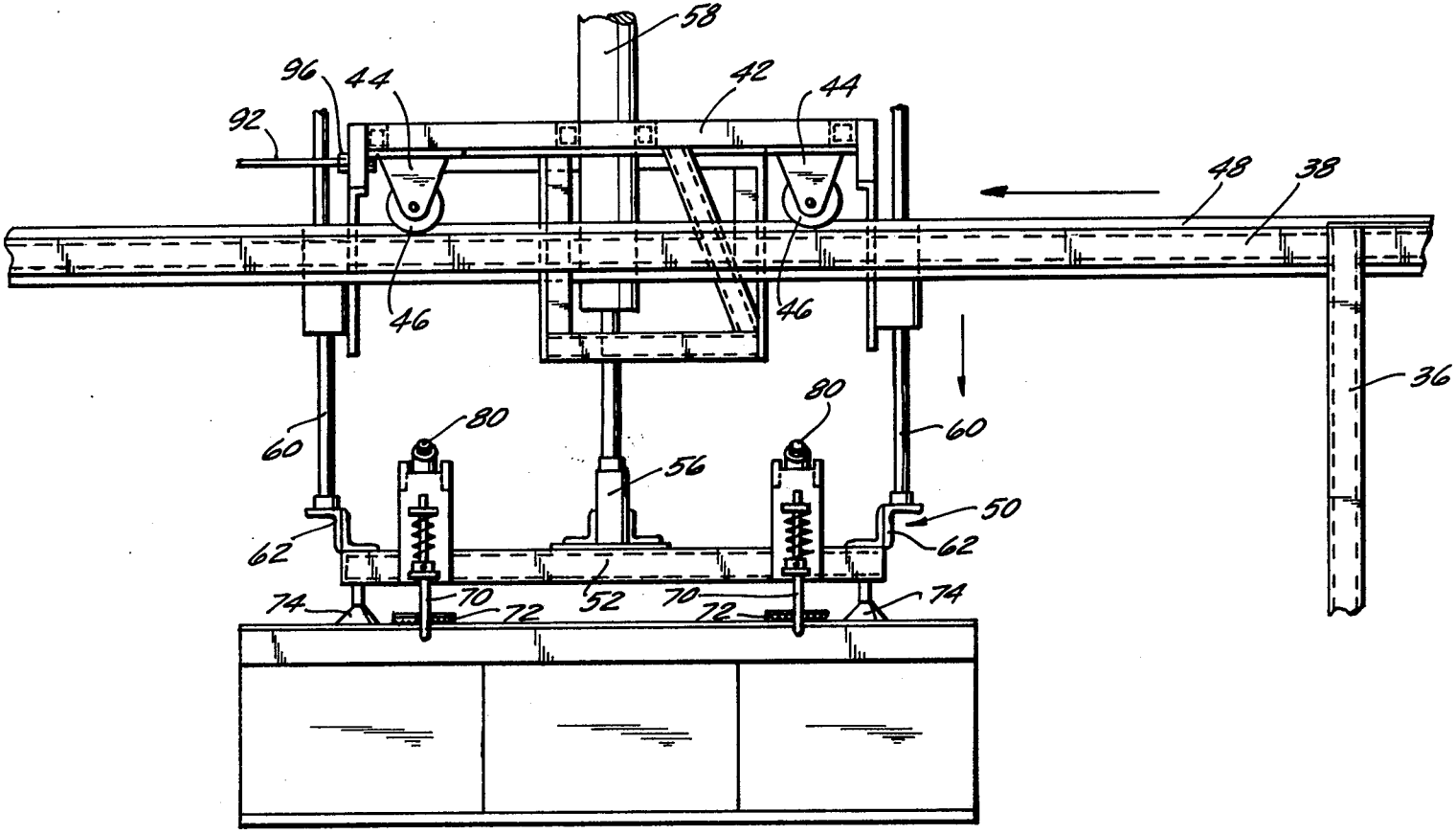
FIG. 7 is a side view of the tier sheet inserter shown in FIG. 3, showing the inserter in the sheet locating position.

FIGS. 3–8 illustrate the structure of the tier sheet inserter and the manner in which the tier sheet inserter is mounted on the palletizer. As shown in FIG. 3, which is an end view of the mechanism, the hoist shaft is defined by four upstanding frame members 35 (two of which are shown in FIG. 3). Mounted above the hoist shaft and the draw plate retraction area K are a series of upstanding frame members 36 which support a pair of horizontally situated frame members 38 by means of cross beams 40. The tier sheet inserter includes a movable carriage 42. Carriage 42 is supported at four locations by wheel brackets 44. Each of the wheel brackets 44 has a wheel 46 rotatably mounted therein. Each of the wheels 46 has a grooved periphery, as illustrated, into which the raised portion of one of the tracks 48, situated along horizontally extending frame members 38, is situated. The interlocking configuration of track 48 and wheel 46 serves to prevent the wheels from leaving the track, thus derailing the carriage. Carriage 42 is movable along rails 48 from a position above the draw plate retraction location, as shown in FIG. 6 to a location above the hoist shaft, as shown in FIG. 7.

The lifting and retaining portions of the tier sheet inserter are very similar to that which is described and illustrated in U.S. Pat. No. 3,809,388, issued May 7, 1974 to Thomas P. Downing and entitled "Machines for Picking a Single Sheet of Material from a Stack". However, the mechanism illustrated and described in this patent has been modified in certain important aspects, so as to achieve a mechanism which is compatible for use on an automatic palletizer and which can accommodate sheets of a variety of different sizes. The tier sheet insertion operation has been integrated into the automatic operation of the palletizer and provides for great versatility because sheets of different sizes can be accommodated, depending upon the requirements of the palletizer.

The operation of the tier sheet inserter is initiated by locating the carriage above stack 34, as shown in FIG. 6. The inserter first buckles the top sheet of stack 34, leaving the upper surface near the edges of the next sheet exposed. A pair of arms are provided to engage the exposed upper surface of the next sheet on the remainder of the stack while suction is applied to the buckled top sheet to lift same. The lifted sheet is then supported as the carriage is moved into the position above the tier situated on the draw plate F. At that point, the suction is discontinued, thereby releasing the sheet and positioning same on the tier. After the sheet has been positioned on the tier, the carriage is moved to its original position to lift the next sheet from stack 34.

The sheet lifting sequence is illustrated with reference to FIGS. 3, 4 and 5. The lifting mechanism is situated on a generally "H" shaped frame, generally designated 50, which consists of a pair of generally parallel variably spaced horizontal members 52 and a connecting member 54. Frame 50 is connected to carriage 42 by means of a piston rod 56, which is connected to cross member 54. Rod 56 is movable with respect to pneumatically operated cylinder 58, which is mounted on carriage 42. In addition, two guide shafts 60, connected to carriage 50, act to guide the movement of frame 50 with respect to carriage 42 as cylinder 58 moves rod 56. As shown in FIG. 3, one of the shafts 60 is provided with a stop 63 thereon to prevent downward movement of frame 50 beyond a certain point with respect to carriage 42. The other shaft 60 is provided with an adjustable cam 64 which coacts with a cam follower 66 and limit switch 68, situated on carriage 42. Switch 68 automatically releases the vacuum holding means, described below, when the frame 50 is in the position illustrated in FIG. 7.

Each of the horizontal frame members 52 has, on each end thereof, a set of elements consisting of a spring loaded holddown arm 70, a pneumatically operated buckling foot 72 and a vacuum cup 74. Thus, each set of elements is located in the vicinity of each of the corners of the sheet on stack 34.

The lifting operation begins by the actuation of pneumatic cylinder 58, so as to lower frame 50 with respect to carriage 42, such that it is positioned near the top of stack 34, as shown in FIGS. 3 and 6. This position is automatically achieved through the use of a switch 76 (FIG. 3), having a sensing arm 78 which senses the top sheet of the stack 34 and causes the operation of cylinder 58 to cease. At this point, buckling feet 72 are in engagement with the top sheet of stack 34 as are spring loaded holddown arms 70. Each of the buckling feet 72 is operatively connected to a different pneumatic cylinder 80 which are then actuated to move the opposite pairs of buckling feet toward each other, as the frame 50 is lowered, again under the control of switch 76 and sensing arm 78, until vacuum cups 74 are situated on the surface of the top sheet. This position is illustrated in FIG. 4, which shows the buckling of the top sheet as cylinders 80 are actuated to move the opposite pairs of buckling feet toward each other. This figure also shows that the ends of holddown arms 70, after cylinders 80 have been actuated, are now situated in engagement with the top of the sheet immediately below the buckled sheet and that the springs associated with holddown arms 70 are in the compressed position.

A vacuum is now created in vacuum cups 74 (FIG. 4) by a pump (not shown) operatively connected thereto through pneumatic tubes (not shown) and the top sheet is held by the vacuum cups. Frame 50 is then moved upwardly towards carriage 52 by pneumatic cylinder 58 so as to lift the buckled sheet from the stack, as shown in FIG. 5. A limit switch 82 and sensor arm 84 are provided on carriage 42 to sense the upward movement of frame 50 to the position wherein the lifted sheet and the remainder of the mechanism is clear of the stack. It should be noted that as the buckled sheet is lifted by the movement of frame 50, holddown arms 70 remain in contact with the next sheet on the stack for a short time as the tension on the springs connected thereto is released. This serves to hold the next sheet on the stack and assure that only a single sheet at a time is lifted therefrom.

After the top sheet has been lifted from stack 34, carriage 42 is moved along tracks 48 to the position shown in FIG. 7. This movement is accomplished by means of a motor 86 (FIGS. 3 and 6) which drives a shaft 88 having a sprocket wheel 90 thereon. A chain 92 is connected to carriage 42 at connector 94. The other end of the chain passes around an idler sprocket (not shown) on the other end of the path of movement and then is connected to carriage 42 by connector 96. In this manner, the rotation of sprocket 90 by motor 86 serves to move carriage 42 along tracks 48 from a position above stack 34 to a position above the draw plate having the newly formed tier situated thereon. The appropriate limit switches are situated along track 48 to control the energization of motor 86 and, thus, the positioning of carriage 42.

As illustrated in FIG. 7, carriage 42 is located above the tier on draw plate F and cylinder 58 is automatically actuated to move frame 50 into a position wherein the lifted sheet is placed on the tier. The vacuum within the vacuum cups 74 is then discontinued, releasing the sheet in its proper position on the tier. Pneumatic cylinder 58 is again actuated, moving the frame 50 upwardly toward carriage 42, until the travel position is detected by sensor arm 84 of switch 82. Motor 86 is then again actuated, this time in the opposite direction, causing the carriage to move from its position above the tier on the unretracted draw plate to its position above the stack 34 and the lifting operation is again initiated as described.

Figure 8:
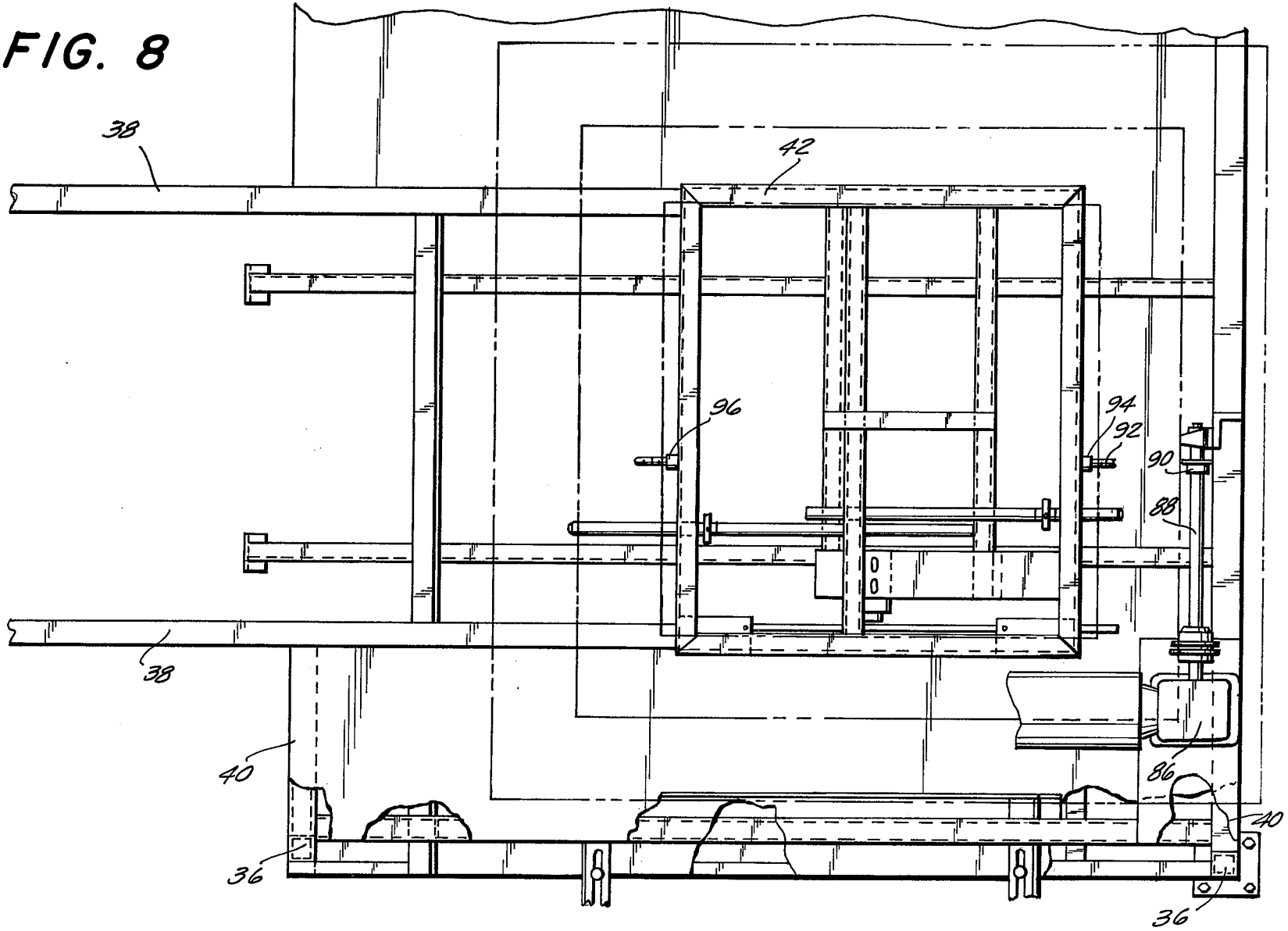
FIG. 8 is a top view of the carriage of the tier sheet inserter shown in FIG. 3, illustrating the different size sheets which the tier sheet inserter can accommodate.

It should be noted that the tier sheet inserter of the present invention is adjustable to operate on sheets of various sizes ranging from 30 × 30 inches to 60 × 60 inches, or any dimensional combination between these limits. The comparative sizes of the smallest and largest sheets which can be accommodated by the mechanism are shown in FIGS. 3 and 8. The manner in which this adjustment is accomplished is by altering the spacing of parallelly situated frame members 52 along connecting member 54. As illustrated in FIGS. 3, 4 and 5, each of the members 52 to which a pair of holddown arms 70, buckling feet 72 and vacuum cups 74 are mounted, are slideably mounted with respect to cross member 54 and are adjustable with respect thereto through the use of a threaded screw 98 which adjusts the relative positions of members 52 along member 54. The system is designed such that rotation of screw 98 in one direction moves members 52 toward each other and the rotation of screw 98 in the opposite direction moves members 52 away from each other. The rotation of screw 98 is achieved manually through the use of a tool (not shown) which is designed to temporarily engage the end of adjusting screw 98 for this purpose. In this manner, the spacing between the active portions of the carriage can be changed from a maximum position in order to accommodate sheets of a variety of different sizes.

It should also be noted, as illustrated in FIG. 6, that a sheet supporting deck or platform, generally designated 100, is situated above area K to which the draw plate G is moved as it is retracted. Support platform 100 is preferably provided with a series of sheet guides 102 to assist the stacker in the appropriate positioning of the stack 34 with respect to the frame and, thus, the tier sheet inserter. Guides 102 are adjustably mounted on support platform 100 such that the position thereof may be changed to accommodate sheets of different sizes.

After the draw plate F has been retracted and the tier containing the sheet thereon is positioned on hoist G, the hoist is lowered along the hoist shaft to a position well below the draw plate F. At this point, a retractable hoist position sensing and control mechanism, generally designated N (see FIGS. 1 and 15), is moved into position. Mechanism N is described in detail in U.S. Pat. No. 3,986,621, issued Oct. 19, 1976, and entitled "Flap Sensor and Hoist Position Control for a Palletizer". Essentially, hoist position sensor N comprises a carriage 104 which is movable along vertical frame members 106, such that a pivotable sensing arm 108 can be moved into position to sense the top of the tier. As the hoist G begins to move vertically upward along the shaft, the top thereof is sensed by sensor arm 108, which is pivoted by the movement thereof. When the top tier is appropriately aligned with the banding mechanism M, the sensing arm 108 is pivoted to a position wherein a switch (not shown) is tripped. This switch stops the movement of hoist G, such that the top tier is appropriately aligned with bander mechanism M and, in addition, actuates the mechanism which retracts the position sensing mechanism N to a position wherein the sensor arm 108 is no longer in the path of vertical movement of hoist G. In this manner, the position of the hoist is controlled, such that the tier to be banded is situated adjacent the banding mechanism M.

Figure 9:
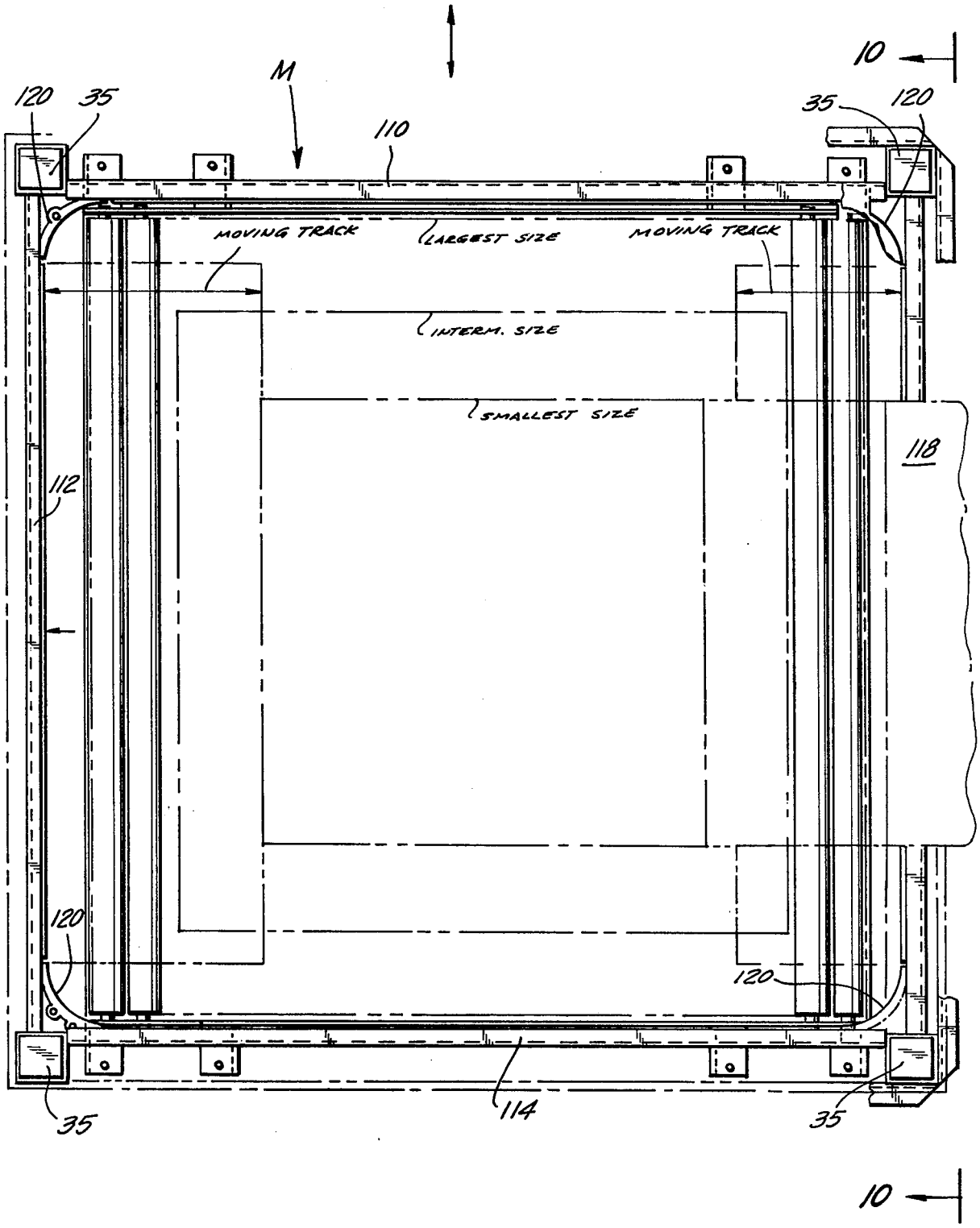
FIG. 9 is a top view of the banding apparatus.
Figure 10:
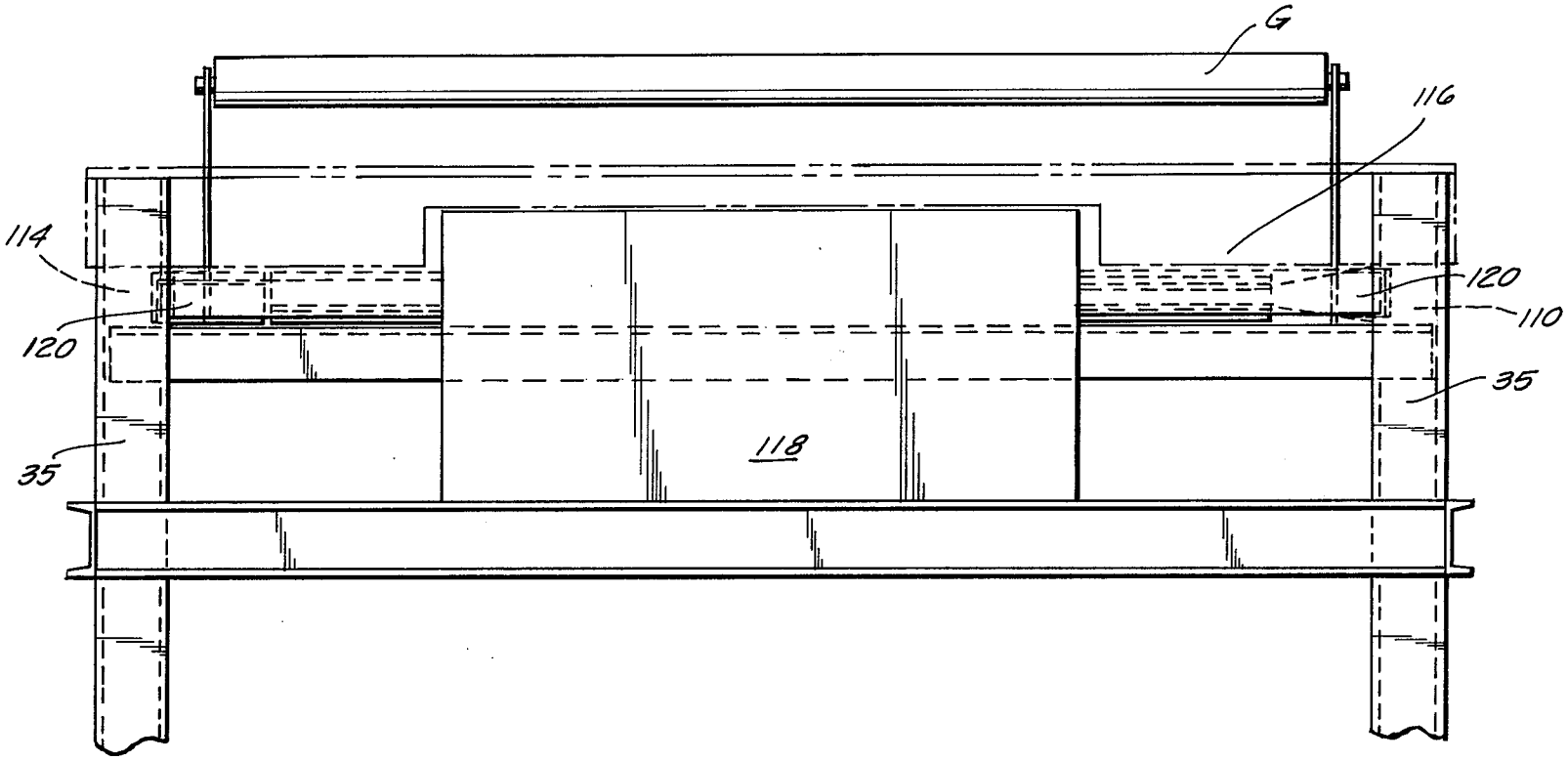
FIG. 10 is an end view taken along line 10—10 of the banding apparatus shown in FIG. 9.

The banding mechanism M is illustrated in FIGS. 9–15. As shown in FIG. 9, which is a top cross-sectional view of the hoist shaft, the hoist shaft is defined at its four corners by upstanding frame members 35. The banding mechanism M consists of a track which encircles the hoist shaft, but which is normally outside the path of movement of the hoist, and is divided into four sections 110, 112, 114 and 116. Sections 110 and 114 are mounted between the adjacent frame members in a fixed manner. Sections 112 and 116 are each mounted on a carriage, described in detail below, which, in turn, is movably mounted with respect to the adjacent upstanding frame members 35, such that sections 112 and 116 can be moved relative to the upstanding frame members 35 toward the center of the hoist shaft. Situated on movable section 116 is the sealing head 118, which moves along with section 116.

As illustrated in FIG. 9, the four shaft sections 110, 112, 114, 116 completely surround the shaft area in which the hoist table G is situated. Each section is provided therealong with a "C" shaped channel (see FIG. 11), along which a strap from a remote reel is fed in a manner identical to that which takes place in commercially available banding or strapping mechanisms, such as those manufactured by Stanley Strapping Systems, a division of Stanley Works, New Britain, Connecticut. After the strap has been positioned or fed from the head around the track in a manner such that it completely encircles the tier on the hoist table, the strap is held and contained by the head and the track sections.

Figure 14:
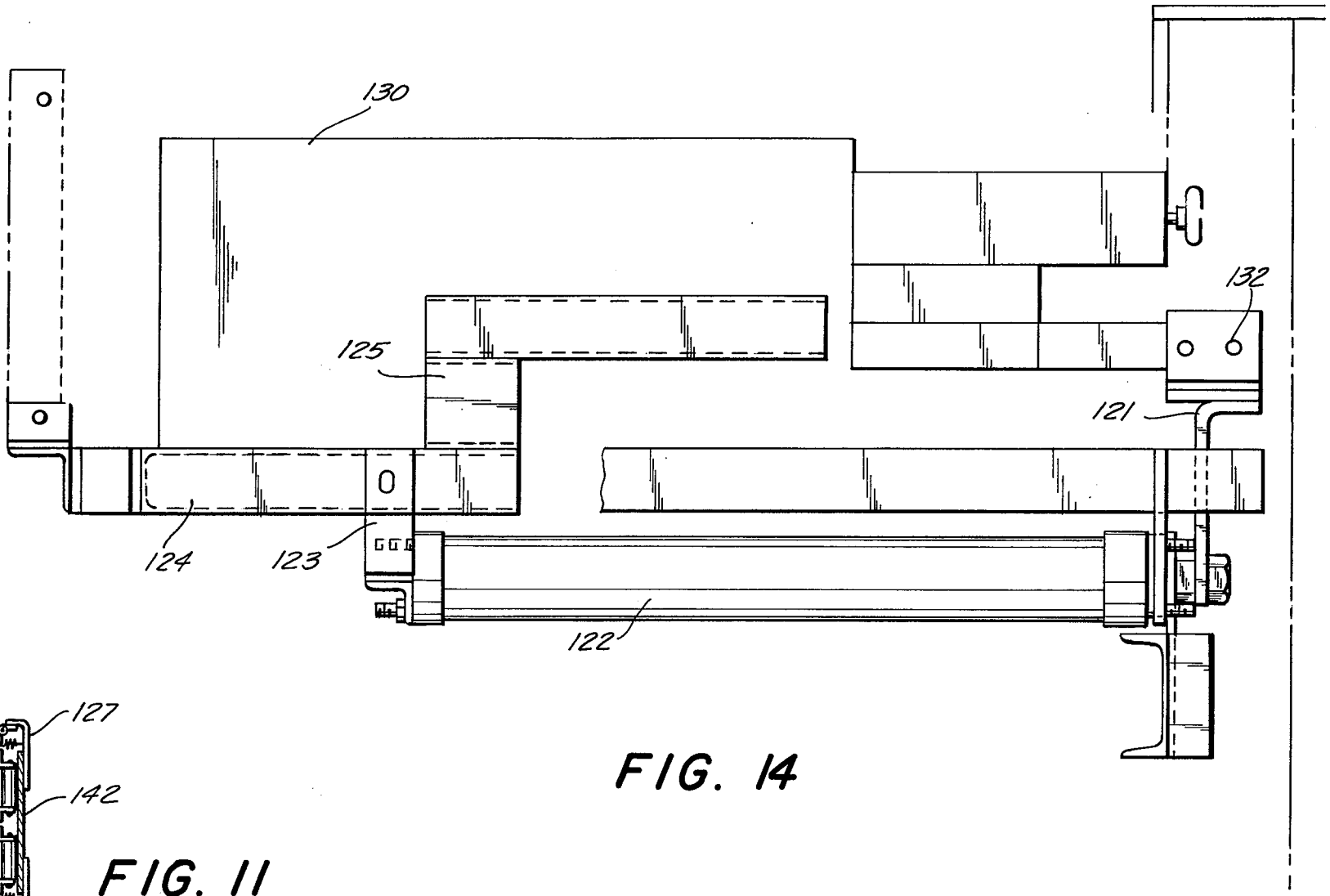
FIG. 14 is a side view of the track moving means shown in FIG. 12.
Figures 12, 13, 14:
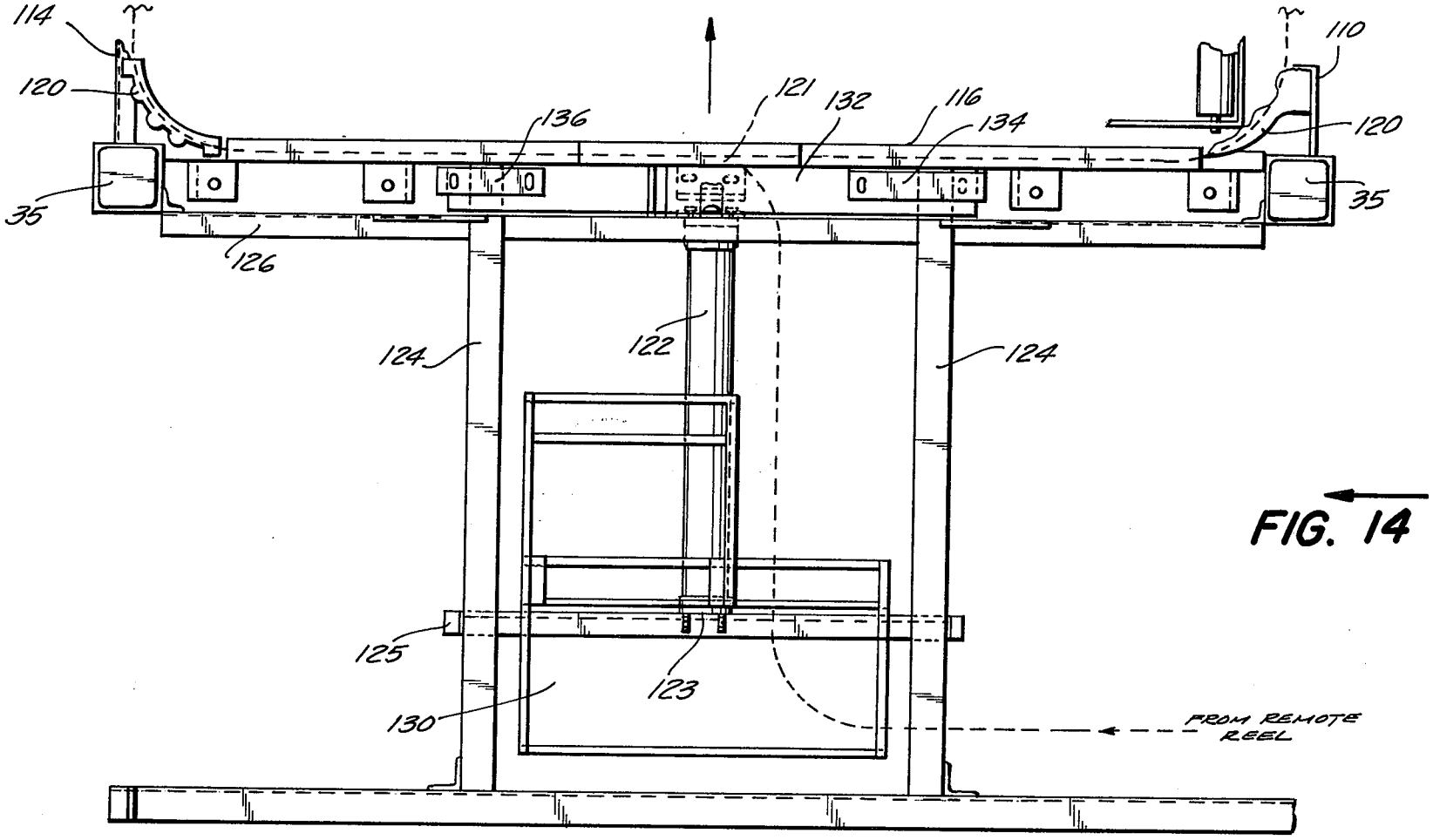
FIG. 12 is a top view of the track moving means of the banding apparatus shown in FIG. 9.
FIG. 13 is an end view of the track moving means shown in FIG. 12.
Figure 13:
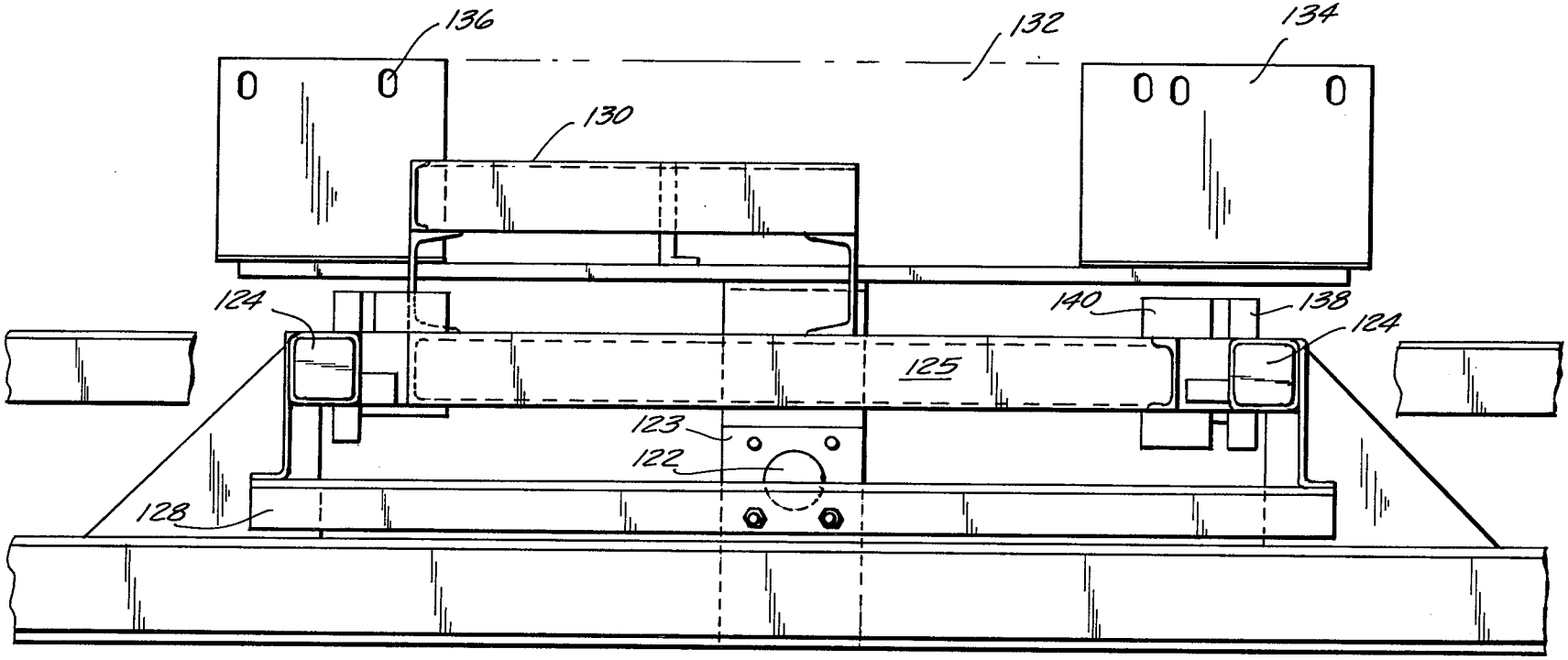

FIGS. 12, 13, 14 show one of the track movement carriages. Sections 110 and 114 have, at either end thereof, a fixed curved section 120 which serve to guide the band or strap from one track segment to the next as it is fed around the track. Track 116 is connected to the piston rod of pneumatic cylinder 122 by a bracket 121. Cylinder 122 is mounted on a bracket 123. Bracket 123 is connected to a cross member 125 between frame sections 124 which, in turn, are connected to a horizontal frame member 126, situated between upstanding frame members 34. Also mounted to member 125 is an enclosure 130 which contains the carriage control means. A mobile section support bar 132, connected to track section 116, is situated between section support angles 134, 136, which support bar 132 as it is moved by cylinder 122. A cam follower 138 and limit switch 140 are provided to automatically control the movement of the carriage.

When cylinder 122 is actuated, the piston rod contained therein is extended, thereby moving track section 116 in the direction of the arrow. It is noted that curved sections 120, which are adjacent to either end of track section 116, remain stationary with respect to adjacent track sections 110 and 114, respectively. Track section 112 is mounted in precisely the same manner as illustrated to track section 116 in FIG. 12 and is equipped with a pneumatic cylinder identical to that of cylinder 122, such that it too can be moved in the manner illustrated with respect to section 116.

When the bander control is energized, the band or strap is fed along the track segments from a remote reel until the tier is completely encircled. Then, strapping head 118, section 116 and section 112, situated between the adjacent curved corner guides 120 at each side thereof, are advanced toward the sides of the tier by the movable carriages. As each of these assemblies contact the side of the tier, a pressure sensitive switch (not shown) is tripped, stopping the advancement of these assemblies. When both assemblies are in position contacting the opposite sides of the tier, the strapping head is actuated to tighten the band. This pulls the strap out of the "C" shaped track channel, the inside top 127 and bottom 129 sections of which are spring held, such that they can move out of the way to permit the strap to escape the track (see FIG. 11). When the strap has been pulled against the outside perimeter of the tier to the desired preset tension, the strap is cut and sealed by sealing head 118. When the seal is completed, the carriage assemblies are retracted to the "home" or normal position. When both assemblies are in the home position, the hoist returns to the top load position, under the draw plate, or continues down to discharge the load, as required.

Figure 11:
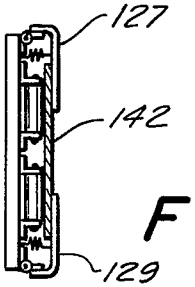
FIG. 11 is a cross-sectional view of a segment of the track of the banding apparatus.

As illustrated schematically in FIG. 12, the strap is stored on a remotely located reel (not shown) and it is from this reel that the strap is guided and fed to the strapping head along the path indicated in dashed lines in this figure. Once the strap is positioned in the head, the strap is pushed or driven around the track. As shown in FIG. 11, the track is a three-piece assembly. The back of the track is the support and vertical guide for strap 142. The top 127 and bottom 129 are held in the closed position by a light spring load. In this manner, the track sections serve to guide and retain the strap until such time as the sealing head tensions the strap to the extent that the top and bottom portions 127, 129 of the track are opened against the spring loading.

Figures 15, 15A, 15B, 15C, 15D, 15E, 15F:
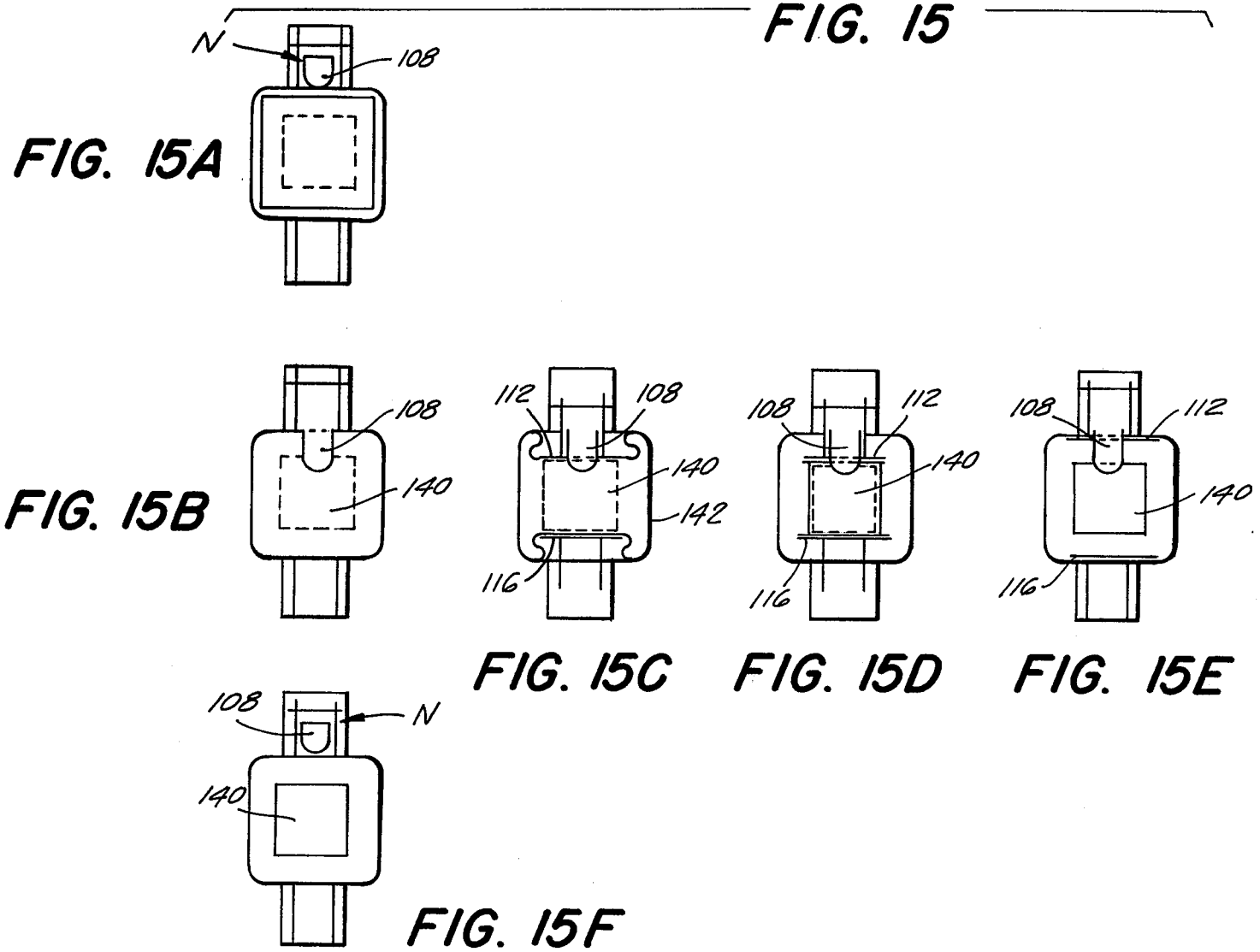
FIG. 15 is a series of schematic sequential views of the banding operation.

The sequence of events is schematically illustrated in FIG. 15. FIG. 15A is a top view of the hoist shaft showing sensing arm 108 in its retracted position. In FIG. 15B, sensor arm 108 has been moved towards the interior of the hoist shaft to sense the position of the tier 140. At this point, the strap 142 is fed around the track sections and sections 112 and 116 are moved adjacent the opposite sides of tier 140 by the respective carriages. The band 142 is shown in its pretensioned position. In FIG. 15D, the head has tensioned band 142 around the tier 140, which has been released from the tracks, and has sealed same. In FIG. 15E, sections 112 and 116 have been retracted to their normal or home positions. In FIG. 15F, sensor arm 108 from the hoist position control mechanism N has been retracted out of the path of movement of the hoist, the banding operation has been completed, and the hoist table G is then repositioned either to accept the next tier from the draw plate or to permit unloading of the pallet, if the banded tier is the final tier to be placed thereon.

It can therefore be seen that the present invention relates to a tier sheet inserter and banding apparatus in combination with a palletizer which permits the automatic palletizing of carton loads wherein tier sheets are automatically inserted therebetween and the tiers thereof are banded, as required, in accordance with the control program. The tier sheet inserter operates automatically and is adjustable to accommodate tier sheets of various sizes to enhance the versatility of the overall palletizer. In addition, the banding mechanism is designed to accommodate tiers of various different dimensions by fashioning the tracks such that they are mobile and can be placed in the appropriate position with respect to the tier to facilitate tensioning and sealing of the strap. The tier sheet insertion operation and the banding operation are controlled by the overall control system of the palletizer, thereby achieving a completely automatic palletizing operation with tier sheet insertion and banding mechanically accomplished in a fashion heretofore not possible.

While only a single preferred embodiment of the present invention is described herein for purposes of illustration, many modifications and variations can be made thereto. It is intended to cover all of these variations and modifications which fall within the scope of the present invention as defined by the annexed claims.

I claim:

1. In a palletizer of the type having a hoist shaft, a hoist, means for moving said hoist within said shaft, a retractable draw plate located above said shaft and means for forming a set of objects to be palletized and for positioning same on said draw plate, when said draw plate is in the unretracted position, the improvement comprising means associated with said shaft at a point below said draw plate for strapping said set of objects together, said hoist moving means being effective, when actuated, to move said hoist to a position wherein said set of objects is aligned with said strapping means, after the retraction of said draw plate.

2. The palletizer of claim 1 wherein said strapping means comprises a track, said track having a plurality of segments normally located relatively outside from but encircling said set of objects, means for conveying a strap along said track, strap tensioning and sealing means associated with one segment of said track and means for moving said one segment and said tensioning and sealing associated therewith to a position adjacent one side of said set of objects to permit tightening and sealing of said strap.

3. The palletizer of claim 2 further comprising means for moving the segment of said track opposite said one segment to a position adjacent the opposite side of said set of objects.

4. The palletizer of claim 2 wherein said means for moving said one segment comprises a carriage upon which said one segment and said tensioning and sealing means are mounted, said carriage being movable between a first position wherein said one segment and said tensioning and sealing means are relatively remote from said one side of said set of objects and a second position wherein said one segment and said tensioning and sealing means are relatively adjacent said one side of said set of objects.

5. The palletizer of claim 3 wherein said means for moving said opposite segment comprises a second carriage upon which said opposite segment is mounted, said second carriage being movable between a first position wherein said opposite segment is relatively remote from said opposite side of said set of objects and a second position wherein said opposite segment is relatively adjacent said opposite side of said set of objects.

6. The palletizer of claim 3 wherein said means for moving said one segment comprises a carriage upon which said one segment and said tensioning and sealing means are mounted, said carriage being movable between a first position wherein said one segment and said tensioning and sealing means are relatively remote from said one side of said set of objects and a second position wherein said one segment and said tensioning and sealing means are relatively adjacent said one side of said set of objects.

7. The palletizer of claim 6 wherein said means for moving said opposite segment comprises a second carriage upon which said opposite segment is mounted, said second carriage being movable between a first position wherein said opposite segment is relatively remote from said opposite side of said set of objects and a second position wherein said opposite segment is relatively adjacent said opposite side of said set of objects.

8. The palletizer of claim 7 wherein said means for moving said one segment and said means for moving said opposite segment further comprise first and second pneumatic cylinders operatively connected to said first and second carriages, respectively, to move same.

9. The palletizer of claim 1 further comprising means for positioning a tier separation sheet on top of said set of objects prior to retraction of the draw plate.

10. The palletizer of claim 9 wherein said sheet positioning means comprises means for supporting a stack of sheets, means for extracting a single sheet from said stack and for retaining same, means for moving said extracting and retaining means to a position wherein said sheet is above said objects and means for releasing said sheet such that said sheet is positioned on top of said set of objects.

11. The palletizer of claim 10 wherein said extracting and retaining means comprises suction means actuatable to hold and lift the top sheet from said stack.

12. The palletizer of claim 11 further comprising means for altering the distance between said suction means such that sheets of different dimensions can be extracted.

13. A palletizer having a hoist shaft, a hoist, means for moving said hoist, a draw plate located above said shaft, means for forming a set of objects to be palletized and for positioning same on said draw plate, means for transferring said objects from said draw plate to said hoist, means for positioning a tier separation sheet on top of said set of objects, and control means for actuating said other means in a predetermined sequence.

14. The palletizer of claim 13 wherein said sheet positioning means is adjustable to accommodate sheets of different dimensions.

15. The palletizer of claim 13 wherein said sheet positioning means comprises means for supporting a stack of sheets, means for extracting a single sheet from said stack and retaining same, means for moving said extracting and retaining means to a position wherein said retained sheet is above said set of objects and means for releasing said sheet such that said sheet is positioned on top of said set of objects.

16. The palletizer of claim 15 wherein said extracting and retaining means comprises suction means actuatable to lift the top sheet from said stack.

17. The palletizer of claim 16 further comprising means for altering the distance between said suction means such that sheets of different dimensions can be extracted.

18. The palletizer of claim 14 further comprising means associated with said shaft below said draw plate for strapping said set of objects together, said hoist being movable to a position wherein said set of objects is aligned with said strapping means, after retraction of said draw plate.

19. The palletizer of claim 18 wherein said strapping means comprises a track, said track having a plurality of segments normally remote from but encircling said set of objects, means for conveying a strap along said track, strap tensioning and sealing means associated with one segment of said track and means for moving said one segment and said tensioning and sealing associated therewith to a position adjacent one side of said set of objects to permit tightening and sealing of said strap.

20. The palletizer of claim 19 wherein said means for moving said one segment comprises a carriage upon which said one segment and said tensioning and sealing means are mounted, said carriage being movable between a first position wherein said one segment and said tensioning and sealing means are relatively remote from said one side of said set of objects and a second position wherein said one segment and said tensioning and sealing means are relatively adjacent said one side of said set of objects.

21. A palletizer comprising a vertical shaft, a hoist, means for moving said hoist within said shaft, a retractable draw plate located above said shaft and means for forming a set of objects to be palletized on said draw plate when the draw plate is in the unretracted position, means located above said draw plate for placing a tier separation sheet on said set of objects, prior to retraction of said draw plate, and means associated with said shaft for sealing a strap around said set of objects, subsequent to the retraction of said draw plate.

22. The palletizer of claim 21 wherein said strapping means comprises a track surrounding, but normally remote from, said set of objects, said track having a plurality of separate segments, means for conveying said strap along said track, means for moving two opposite segments of said track adjacent said set of objects, means for tensioning and sealing said strap, said last mentioned means tightening said strap around said set of objects causing said strap to be released from said track, and subsequently sealing same.

23. The palletizer of claim 21 wherein said sheet positioning means comprises means for supporting a stack of sheets, means for extracting a sheet from said stack and placing same on said set of objects, said extracting means comprises sheet retaining means, said sheet retaining means being adjustable to accommodate sheets of different sizes.

* * * * *